US005667134A

United States Patent [19]

Olson et al.

[11] Patent Number: 5,667,134

[45] Date of Patent: Sep. 16, 1997

[54] VARIABLY DUPLEX-IMAGED AND SEALED DOUBLE POSTCARD CHECK

[75] Inventors: James L. Olson, Chanhassen, Minn.; Elaine C. Ropson, Libertyville, Ill.

[73] Assignee: Moore Business Forms, Inc., Grand Island, N.Y.

[21] Appl. No.: 699,015

[22] Filed: Aug. 16, 1996

[51] Int. Cl.[6] ..... B65D 27/00

[52] U.S. Cl. ..... 229/928; 229/70; 283/58

[58] Field of Search ..... 229/92.8, 92.1, 229/70, 305; 283/58

[56] References Cited

U.S. PATENT DOCUMENTS

| | | | |
|---|---|---|---|
| 203,409 | 5/1878 | Brooks | 229/92.1 |
| 283,841 | 8/1883 | Williamson . | |
| 1,264,795 | 4/1918 | Hill | 229/92.8 |
| 1,299,021 | 4/1919 | Planche | 299/92.1 |
| 1,946,751 | 2/1934 | McCarthy | 229/92.8 X |
| 2,074,821 | 3/1937 | Wissmann . | |
| 2,831,707 | 4/1958 | James, Jr. et al. | 229/70 X |
| 2,985,464 | 5/1961 | McFarland . | |
| 4,585,160 | 4/1986 | Fiske, II | 283/58 X |
| 5,062,570 | 11/1991 | Ashby . | |
| 5,085,470 | 2/1992 | Peach et al. . | |
| 5,207,373 | 5/1993 | Tighe | 229/305 X |
| 5,308,119 | 5/1994 | Roshkoff . | |
| 5,435,600 | 7/1995 | Griffiths et al. . | |
| 5,566,981 | 10/1996 | Alcordo | 283/58 |

*Primary Examiner*—Jes F. Pascua
*Attorney, Agent, or Firm*—Nixon & Vanderhye P.C.

[57] ABSTRACT

A mailer intermediate, and a combination postcard and negotiable instrument mailer, are provided which has the benefit of postcard postal rates, yet provides the confidentiality of a mailer. The intermediate is formed by a quadrate sheet of cellulose based stock with first and second parallel lines of weakness (e.g., perforations) extending substantially transverse to the side edges of the sheet and dividing the sheet into an outgoing address portion, a negotiable instrument portion, and a combination security and reply portion. When the sheet is folded about the first line of weakness to form a mailer, the mailer has postcard-sized dimensions (e.g., about 4.25"×6") with the outgoing addressee indicia image on the outside face of the address portion and negotiable instrument indicia (including payee and MICR indicia) on the inside of the mailer, negotiable instrument portion. The outgoing address portion has a width of about 1.2–1.6 inches from an end edge of the mailer, and folded over intermediate portions are held together by first and second patterns of adhesive, such as spaced glue spots.

21 Claims, 3 Drawing Sheets

FIG. 3
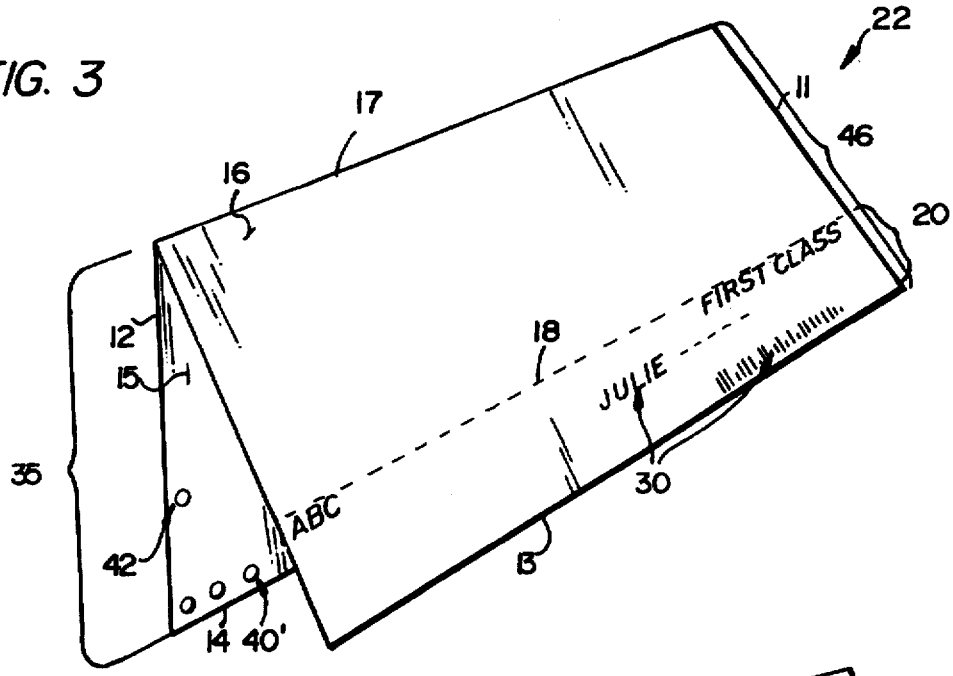
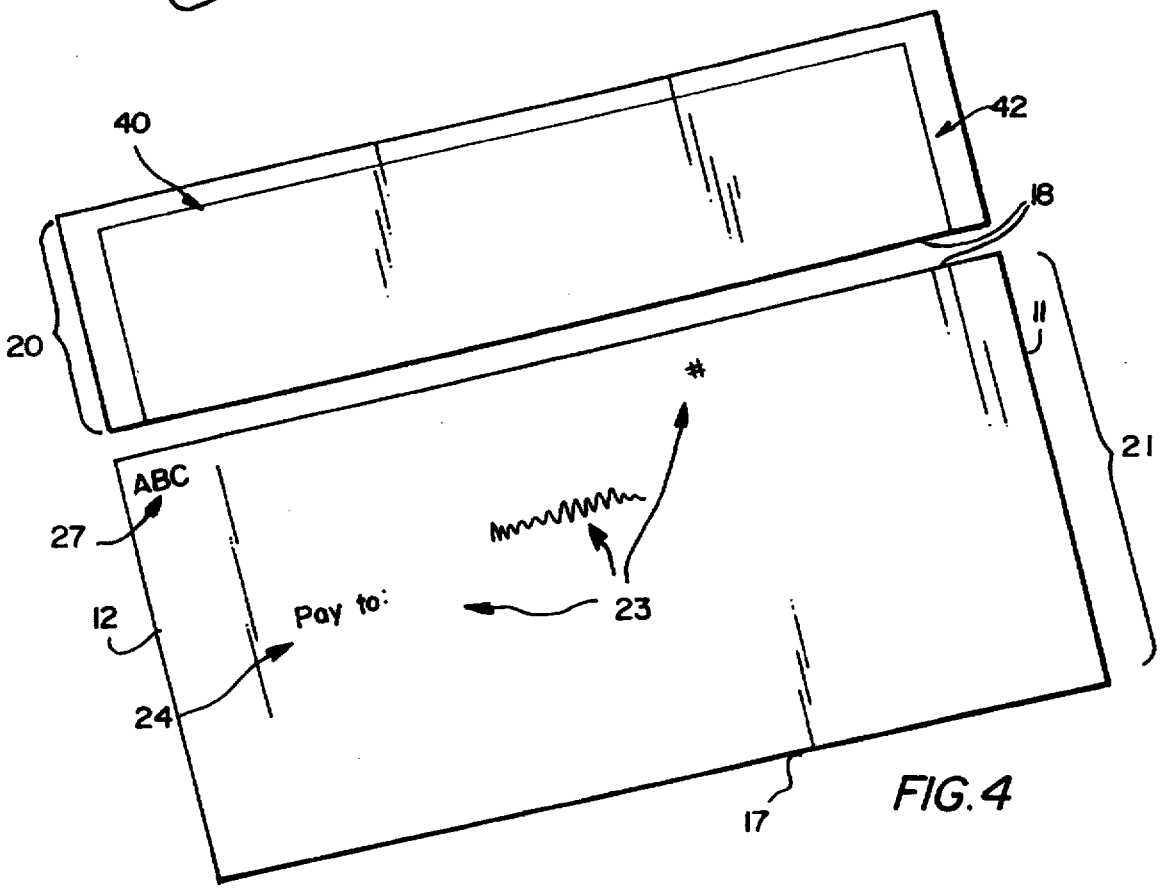
FIG. 4

VARIABLY DUPLEX-IMAGED AND SEALED DOUBLE POSTCARD CHECK

BACKGROUND AND SUMMARY OF THE INVENTION

Traditionally, postal rates for first-class mailings have differed significantly between letters and postcards. For non-automation mailings the difference in rate between First Class letters and postcards can be as much as 12¢, with present and projected differences for all different classes of non-automation and automation letters and postcards being a minimum of about 9.4¢. This provides a significant incentive to utilize postcards for a wide variety of specialized mailings. However, despite the long-recognized savings that are possible, mailings for negotiable instruments have heretofore not taken much advantage of these differences in postal rates.

While there have been a significant number of proposals in the past for combining postcards and negotiable instruments, such as shown in U.S. Pat. Nos. 283,841, 1,264,795 and 5,085,470, such proposals have not been particularly successful. In each of these proposals, a postcard is provided which has a negotiable instrument such as a check or money order on one face, and mailing address and postage indicia on the opposite face; or negotiable instrument indicia and mailing indicia on the same face. Perhaps one reason why these procedures have not been particularly successful is that there is a lack of confidentiality associated with them, meaning that if the negotiable instruments are for anything but small amounts of money, there is significantly increased possibility of theft, and certainly an undesirable lack of respect for the privacy of the addressee/payee. Also, when the negotiable instrument indicia is exposed during mailing it has the possibility of being defaced by foreign substances, or smeared, perhaps even to such an extent that a bank or financial institution will not accept the negotiable instrument.

According to the present invention a mailer intermediate, and a combination postcard and negotiable instrument mailer, are provided which have the advantages of earlier proposals for combined postcards and negotiable instruments, but without the drawbacks. The mailers according to the present invention take advantage of the smaller first-class postal rates for postcards, yet provide privacy and protection for the negotiable instruments forming part of the mailers. The mailers according to the present invention are constructed from a single sheet of cellulose based (e.g. paper) stock which is preferably duplex imaged utilizing any conventional imaging techniques, and simply folded and held together to provide confidentiality of a negotiable instrument on the interior face thereof, yet the negotiable instrument is not in any way defaced. These desirable results are preferably achieved according to the invention by providing one portion of the single sheet which provides for confidentiality and also may be utilized as a reply mailing, and by the second portion which is divided into a negotiable instrument portion and an outgoing address portion, the two portions being separable by a line of weakness such as a perforation line.

According to one aspect of the present invention a mailer intermediate foldable into postcard size is provided. The term "postcard" or "postcard size" as used in the present specification and claims means mailings which are smaller than conventional letters and have a favorable postage differentiation provided under United States Postal Service schedules. The mailer intermediate comprises: A quadrate sheet of cellulose based stock having first and second side edges, first and second end edges, and first and second faces. A first line of weakness extending substantially transverse to the side edges and substantially bisecting them. A second line of weakness extending substantially transverse to the side edges and between the first line of weakness and the first end edge, the second line of weakness closer to the first end edge than to the first line of weakness, and dividing the sheet into an outgoing address portion between the first end edge and the second line of weakness, and a negotiable instrument portion between the first and second lines of weakness. The quadrate sheet dimensioned so that when folded about the first line of weakness to form a mailer, the mailer has postcard size dimensions. And negotiable instrument indicia, including payee indicia, imaged on the first face negotiable instrument portion.

The outgoing addressee indicia is typically imaged on the second face outgoing address portion, and the negotiable instrument indicia is upside down with respect to the outgoing addressee indicia. A first adhesive pattern is typically formed on a first face adjacent the first end edge. A second adhesive portion may be formed on the first face along each of the side edges and the outgoing address portion. On the opposite side of first line of weakness from the negotiable instrument portion may comprise a reply portion, with reply addressee indicia imaged on the reply portion first face. The reply addressee indicia preferably has the same orientation as the negotiable instrument indicia, the first and second faces of the quadrate sheet being readily duplex imaged utilizing any type of conventional imaging equipment either the impact type, or preferably the non-impact type (such as the MIDAX™ high speed, toner-based, electrostatic imaging process known as ion deposition).

The first and second lines of weakness may comprise perforations, die cuts, fold lines, or score lines, and preferably are perforation lines. The size of the quadrate sheet in order to secure an effective postcard size of the mailer form therefrom, while providing significant area for a negotiable instrument, preferably comprises sheet side edges having a length of about 8.5 inches, and end edges having a length of about 6 inches. The second line of weakness is spaced from the first end edge a distance of between about 1.2–1.6 inches, e.g. about 1.5 inches. A negotiable instrument may be of any type of negotiable instrument such as a bank check, money order, or the like, and preferably includes payee, dollar amount, and MICR indicia. The reply portion may include survey indicia, having the same orientation as the outgoing addressee indicia.

According to another aspect of the present invention a mailer intermediate foldable into postcard size is provided comprising the following components: A quadrate sheet having first and second side edges, first and second end edges, and first and second faces, wherein the side edges have a length of about 8.5 inches, and the end edges have a length of about 6 inches. A first line of weakness extending substantially transverse to the side edges and substantially bisecting them. A second line of weakness extending substantially transverse to the side edges and between the first line of weakness and the first end edge, the second line of weakness spaced from the first end edge a distance of between about 1.2–1.6 inches and dividing the sheet into an outgoing address portion between the first end edge and the second line of weakness, and a second portion between the first and second lines of weakness. First indicia imaged on the first face second portion. And outgoing addressee indicia imaged on the second face outgoing address portion.

According to yet another aspect of the present invention, a combination postcard and negotiable instrument mailer is provided comprising the following elements: A first quadrate cellulose material panel having a top face and a bottom face, first and second end edges, and first and second side edges. A second quadrate cellulose material panel having a top face and a bottom face, first and second edge edges, and first and second side edges. The bottom face of the first panel in face-to-face engagement with the top face of the second panel, with the first and second side and end edges of each substantially aligned with each other. The first and second panels integral at the second end edges thereof. The first and second panels each being of postcard size. A first adhesive pattern connecting the first and second panels together adjacent the first end edges thereof. A line of weakness formed in the first panel substantially transverse to the first and second side edges and substantially parallel to the first and second end edges thereof. Outgoing addressee indicia imaged on the top face of the first panel between the first end edge and the line of weakness. And negotiable instrument indicia, including payee indicia, imaged on the bottom face of the first panel between the second end edge and the line of weakness.

Preferably the outgoing addressee indicia includes name indicia that is the same as the name indicia of the payee indicia. Also the combination further comprises a second adhesive pattern connecting first and second panels together adjacent both the side edges thereof between the first end edges thereof in the line of weakness. The first pattern may be lines, zigzags, interrupted blocks, or preferably spaced dots. The second adhesive pattern may only be a single dot on each side, not exceeding one-quarter inch diameter. The adhesive may be any suitable conventional adhesive including rewettable, pressure activated, pressure sensitive, or heat activated. Spaced heat or pressure activated dots are preferred because they securely hold the panels together but allow ready separation.

The combination typically further comprises reply address indicia imaged on the top face of the second panel, and survey indicia imaged on the bottom face of the second panel. The side edges have a length of about 4.25 inches, the end edges have a length of about 6 inches, and the line of weakness is spaced from the first end edge of the first panel a distance of between about 1.2–1.6 inches (e.g. about 1.5 inches).

It is a primary object of the present invention to provide an intermediate for a mailer, and a mailer, which includes a negotiable instrument having confidentiality associated therewith, yet takes advantage of the significantly lower First Class rates for postcards compared to letters. This and other objects of the invention will become clear from an inspection of the detailed description of the invention and from the appended claims.

BRIEF DESCRIPTION OF THE DRAWINGS

FIG. 3 is a top perspective view showing the mailer intermediate of FIGS. 1 and 2 being folded to form a mailer according to the present invention; and FIG. 4 shows a negotiable instrument and address portions of the mailer of FIG. 3 after the mailer has been opened and the negotiable instrument and outgoing address portions separated.

DETAILED DESCRIPTION OF THE DRAWINGS

Figure 1:
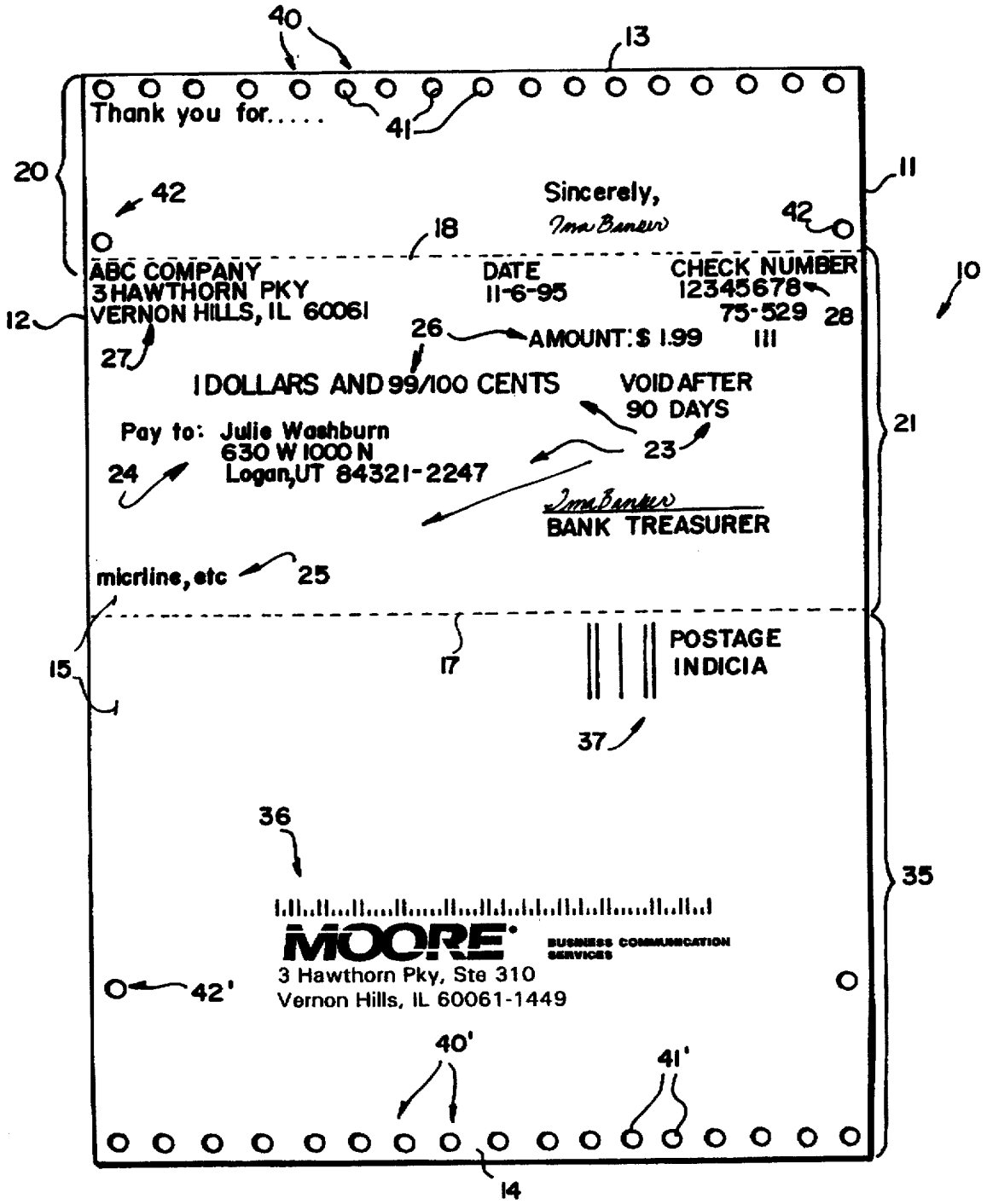
FIG. 1 is a top plan view of an exemplary mailer intermediate foldable into postcard size, according to the present invention.
Figure 2:
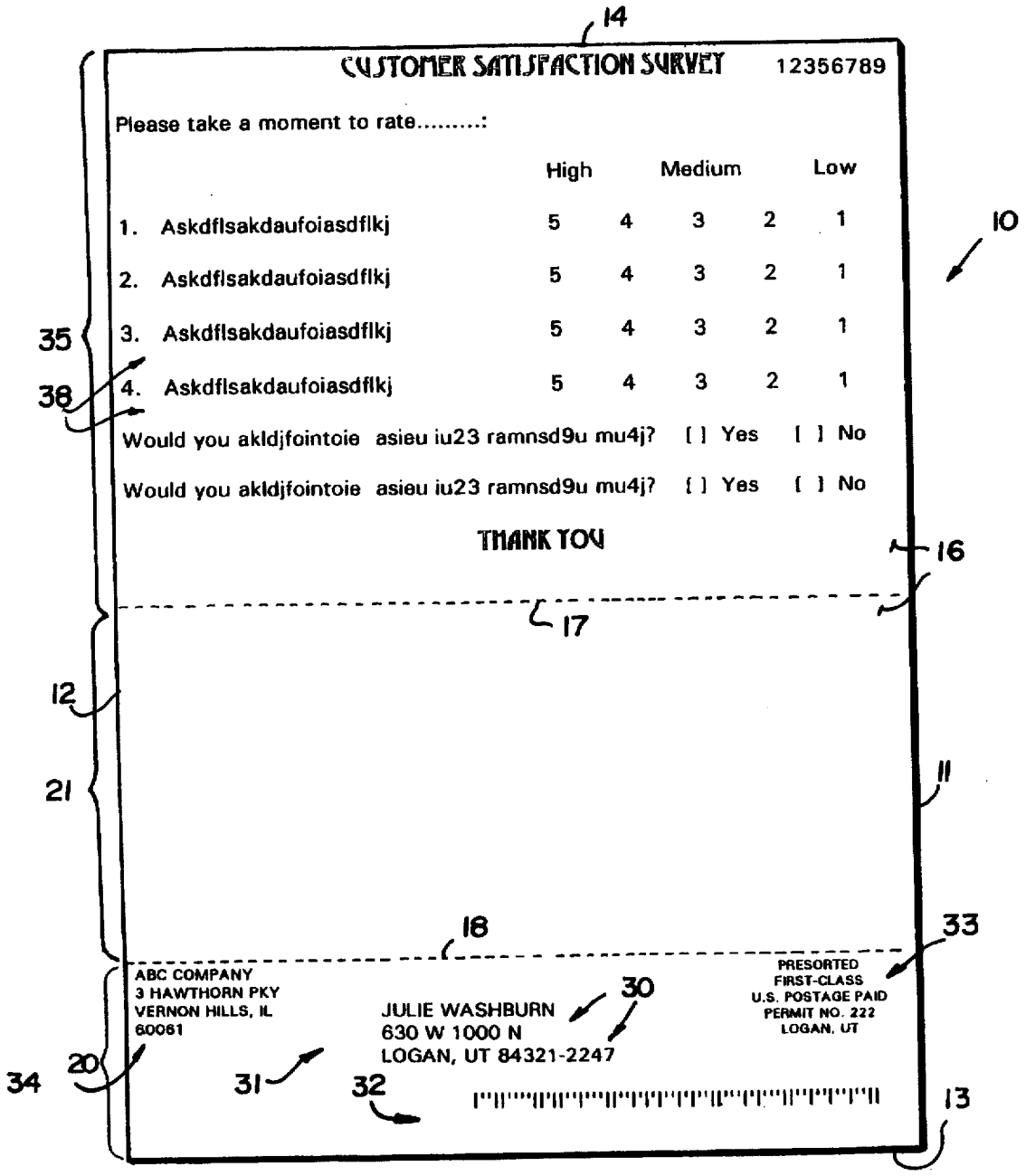
FIG. 2 is a bottom plan view of the mailer of FIG. 1.

FIGS. 1 and 2 illustrate generally by reference numeral 10 a mailer intermediate foldable into postcard size. The mailer intermediate comprises a quadrate sheet of cellulose based stock (typically postcard stock, such as 120 pound per 1000 sheet ream Tag, or 110 pound per 1000 sheet ream Index) having first and second side edges 11, 12, respectively, and first and second end edges 13, 14, respectively, and first and second faces 15, 16. A first line of weakness 17 extends substantially transverse to the side edges 11, 12, substantially bisecting them (that is the line 17 being substantially parallel to and substantially equidistance from the end edges 13, 14), and a second line of weakness 18 parallel to the first line 17 and extending between the first line 17 and the first end edge 13. The lines of weakness 17, 18 may be any conventional lines of weakness. Preferably they are perforation lines, but may also comprise die cut lines, score lines, fold lines, or the like.

The second line of weakness 18 is closer to the first end edge 13 than to the first line of weakness 17, and divides the sheet into an outgoing address portion between the first end edge 13 and the second line of weakness 18, and a negotiable instrument portion 21 between the first and second lines of weakness 17, 18.

The quadrate sheet forming the intermediate 10 is dimensioned so that when folded about the first line of weakness 17 to form a mailer (such as the mailer 22 illustrated in FIG. 3), the mailer 22 has postcard size dimensions. While the exact dimensions may vary, the objectives according to the present invention are—pursuant to present USPS regulations and rates—optimized when the length of each of the sides 11, 12 is about 8.5 inches, the length of the end edges 13, 14 are about 6 inches, and the spacing between the end edge 13 and the second line of weakness 18 is between about 1.2–1.6 inches, preferably about 1.5 inches.

The intermediate 10 also includes negotiable instrument indicia—shown generally by reference numeral 23 in FIGS. 1 and 4—including payee indicia 24, imaged on the first face 15 of the negotiable instrument portion 21. Imaging may be provided by any conventional imaging technique including impact techniques and non-impact techniques. Since in the preferred embodiment the intermediate 10 is preferably duplex imaged in a high speed, high resolution manner, one preferred imaging technique is the MIDAX™ high speed, toner-based, electrostatic imaging process known as ion deposition and commercialized by Moore Business Forms, Inc. of Lake Forest, Ill. Other exemplary indicia provided on the face 15 of the negotiable instrument portion 21 include—as seen in FIG. 1—MICR indicia 25, amount indicia 26, issuing organization indicia 27, and negotiable instrument number 28, as well as data, expiration date, signature indicia, and the like.

The intermediate 10—as seen in FIG. 2—also preferably includes outgoing addressee indicia—illustrated schematically at 30 in FIG. 2—imaged on the second face 16 on the outgoing address portion 20. The indicia 30 typically includes human readable outgoing address indicia 31 (which typically is at least partially the same as the payee indicia 24 on the first face 15), and corresponding bar code indicia 32. Also, postage indicia 33 and return address indicia 34 are provided.

The sheet forming the intermediate 10 comprises, on the opposite side of the first line of weakness 17 from the negotiable instrument portion 21, a reply portion 35 (see FIG. 1) having reply addressee indicia 36 imaged on the portion 35 perfoereof. The reply portion 35 performs the primary function of providing confidentiality of the negotiable instrument portion 21 when the intermediate 10 is folded into a mailer 22, but also is a perfect vehicle for providing a return/reply mailer, for example if the entity issuing the negotiable instrument 21 is interested in payee feedback. For most effective duplex printing the reply indicia 36 has the same orientation (that is they are both readable when viewed as seen in FIG. 1) as the indicia on the negotiable instrument portion 21. Since the indicia 36 is also covered up in the mailer 22, it cannot confuse where the mailer 22 should be directed. Postage indicia 37 is also preferably provided, for example, in the form of a first-class permit number, or indicia "place stamp here", or the like.

On the second face 16 of the reply portion 35 survey indicia 38 may be imaged, as illustrated in FIG. 2. Again to facilitate duplex imaging the survey indicia 38 has the same orientation as the outgoing addressee indicia 30, and typically the indicia 23, 26 has the opposite orientation from the indicia 30, 38 (that is the indicia 33 being upside down with respect to the indicia 30, and vice versa).

In order to hold the portions 20 and 21, and 35, together in the formed mailer 22 in order to provide the desired level of confidentiality and ease of mailing of the mailer 22, means must be provided for holding the first faces 15 of the negotiable instrument portion 21 and reply portion 35 together in face-to-face relationship. This is preferably accomplished according to the invention by providing a first adhesive pattern 40 (see FIGS. 1 and 4) formed on the first face 15 adjacent the first end edge 13. The pattern 40 may take a wide variety of forms depending on the exact adhesive used and other requirements. For example, it may comprise a continuous strip, a discontinuous strip, spaced blocks, zigzag configuration, or the like, although it is preferred that spaced dots 41 of adhesive—as illustrated in FIG. 1—be provided. Adhesives that may utilized include rewettable adhesive, pressure sensitive or pressure activated adhesives, heat activated adhesive, or the like (preferably of permanent construction, although removable adhesives may sometimes be utilized). Spaced dots 41 are desirable since they provide effective holding yet allow ready separation, for example by inserting an instrument between dots 41, or by separating along the edge first and then continuing the separating force parallel to the end edge 13. Depending upon the particular type of adhesive it may be desirable to provide a complementary pattern 40', such as complementary adhesive dots 41', adjacent the edge 14, or the pattern of adhesive may only be provided along/adjacent the edge 14 as indicated at 40' in FIG. 1.

To provide effective holding of the mailer 22 as an integral unit while not in any way defacing or otherwise adversely affecting the negotiability of the negotiable instrument 21, a second pattern of adhesive, illustrated schematically at 42 in FIGS. 1 and 4, may be provided. The second pattern 42 may be a single dot of glue, not larger than about ¼" in diameter positioned immediately below the perforation and not to extend into the negotiable document portion 21. Again, depending upon the particular type of adhesive, a complementary, cooperating, second single dot of glue, not larger than about 0.25 inches in diameter may be utilized.

FIG. 3 illustrates a combination postcard and negotiable instrument mailer 22 according to the present invention just before the activation of the adhesive patterns (40' 42' seen in FIG. 3). In the mailer 22 the portions 20, 21 comprise a first panel 46 while the reply portion 35 comprises a second panel. The second face 16 of the first panel 46 is the top face of the mailer 22 panel 46, while the first face 15 of the panel 46 (containing the negotiable instrument indicia 23) comprises a bottom face of the panel 46. Half of each of the side edges 11, 12 of the intermediate form the side edges of the panel 46, while the first end edge is formed by the first end edge 13 of the intermediate 10, and the second end edge of the panel 46 is formed by the first line of weakness 17, the panels 46, 35 being integral at a common second end edge (the line of weakness 17) thereof. The length of the edges 11, 12 of each of the panels 46, 35 of the mailer 22 are—in the preferred embodiment—about 4.25 inches. Similarly, the first face 15 of the reply portion 35 forms the top face of the panel 35 (including the reply address indicia 36), while the second face 16 of the reply portion 35 comprises a bottom face of the second panel 35, and a first end edge of the second panel 35 comprises the second end edge 14 of the intermediate 10.

After the mailer 22 has been mailed to the outgoing addressee (as indicated by indicia 30), the outgoing addressee opens up the mailer 22 by detachment of the patterns 42, and/or 42', and 40 and/or 40'. Then panels 46, 35 are separated by tearing along the first perforation line 17, and then the first panel 46 is separated into the outgoing address portion 20 and the negotiable instrument portion 21 by tearing along the perforation line 18, as illustrated in FIG. 4. That leaves the negotiable instrument 21 in good shape, without the indicia 23 thereon having been defaced, and having been maintained confidential, with any tearing of any portions of the cellulose stock forming the mailer 22 being restricted to the outgoing address portion 20 which may be discarded or recycled. The survey indicia 38 on the reply portion 35 may be filled out by the payee/outgoing address, and then the reply portion 35 mailed to the reply address 36.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A mailer intermediate foldable into postcard size, comprising:

a quadrate sheet of cellulose based stock having first and second side edges, first and second end edges, and first and second faces;

a first line of weakness extending substantially transverse to said side edges and substantially bisecting them;

a second line of weakness extending substantially transverse to said side edges and between said first line of weakness and said first end edge, said second line of weakness closer to said first end edge than to said first line of weakness, and dividing said sheet into an outgoing address portion between said first end edge and said second line of weakness, and a negotiable instrument portion between said first and second lines of weakness;

said quadrate sheet dimensioned so that when folded about said first line of weakness to form a mailer, the mailer has postcard size dimensions; and negotiable instrument indicia, including payee indicia, imaged on said first face negotiable instrument portion.

2. A mailer intermediate as recited in claim 1 further comprising outgoing addressee indicia imaged on said second face outgoing address portion.

3. A mailer intermediate as recited in claim 2 wherein said negotiable instrument indicia is upside down with respect to said outgoing addressee indicia.

4. A mailer intermediate as recited in claim 2 further comprising a first adhesive pattern formed on said first face adjacent said first end edge.

5. A mailer intermediate as recited in claim 4 further comprising a second adhesive pattern formed on said first face along each of said side edges in said outgoing address portion.

6. A mailer intermediate as recited in claim 2 wherein said sheet on the opposite side of said first line of weakness from said negotiable instrument portion comprises a reply portion; and further comprising reply addressee indicia imaged on said reply portion first face.

7. A mailer intermediate as recited in claim 6 wherein said reply addressee indicia has the same orientation as said negotiable instrument indicia.

8. A mailer intermediate as recited in claim 7 further comprising survey indicia imaged on said reply portion second face, said survey indicia having the same orientation as said outgoing addressee indicia.

9. A mailer intermediate as recited in claim 1 further comprising a first adhesive pattern formed on said first face adjacent one or both of said end edges.

10. A mailer intermediate as recited in claim 9 further comprising a second adhesive pattern formed on said first face adjacent said side edges, extending a distance from an end edge less than the spacing of said second line of weakness from said first end edge.

11. A mailer intermediate as recited in claim 1 wherein said side edges have a length of about 8.5 inches, and said end edges have a length of about 6 inches, and said second line of weakness is spaced from said first end edge a distance of between about 1.2–1.6 inches.

12. A mailer intermediate as recited in claim 1 wherein said first and second lines of weakness are perforation lines.

13. A combination postcard and negotiable instrument mailer, comprising:

a first quadrate cellulose material panel having a top face and a bottom face, first and second end edges, and first and second side edges;

a second quadrate cellulose material panel having a top face and a bottom face, first and second edge edges, and first and second side edges;

said bottom face of said first panel in face-to-face engagement with said top face of said second panel, with said first and second side and end edges of each substantially aligned with each other;

said first and second panels integral at said second end edges thereof;

said first and second panels each being of postcard size;

a first adhesive pattern connecting said first and second panels together adjacent said first end edges thereof;

a line of weakness formed in said first panel substantially transverse to said first and second side edges and substantially parallel to said first and second end edges thereof;

outgoing addressee indicia imaged on said top face of said first panel between said first end edge and said line of weakness; and negotiable instrument indicia, including payee indicia, imaged on said bottom face of said first panel between said second end edge and said line of weakness.

14. A combination postcard and negotiable instrument as recited in claim 13 wherein said outgoing addressee indicia includes name indicia that is the same as name indicia of said payee indicia.

15. A combination postcard and negotiable instrument as recited in claim 13 further comprising a second adhesive pattern connecting said first and second panels together adjacent both said side edges thereof between said first end edges thereof and said line of weakness.

16. A combination postcard and negotiable instrument as recited in claim 13 wherein said outgoing address indicia includes bar code indicia, and wherein said negotiable instrument indicia includes MICR indicia.

17. A combination postcard and negotiable instrument as recited in claim 13 further comprising reply address indicia imaged on said top face of said second panel.

18. A combination postcard and negotiable instrument as recited in claim 17 further comprising survey indicia imaged on said bottom face of said second panel.

19. A combination postcard and negotiable instrument as recited in claim 13 wherein said side edges have a length of about 4.25 inches, and said end edges have a length of about 6 inches, and said line of weakness is spaced from said first end edge of said first panel a distance of between about 1.2–1.6 inches.

20. A mailer intermediate foldable into postcard size, comprising:

a quadrate sheet having first and second side edges, first and second end edges, and first and second faces, wherein said side edges have a length of about 8.5 inches, and said end edges have a length of about 6 inches;

a first line of weakness extending substantially transverse to said side edges and substantially bisecting them;

a second line of weakness extending substantially transverse to said side edges and between said first line of weakness and said first end edge, said second line of weakness spaced from said first end edge a distance of between about 1.2–1.6 inches and dividing said sheet into an outgoing address portion between said first end edge and said second line of weakness, and a second portion between said first and second lines of weakness;

first indicia imaged on said first face second portion; and outgoing addressee indicia imaged on said second face outgoing address portion.

21. A mailer intermediate as recited in claim 20 wherein said first indicia comprises negotiable instrument indicia, including payee and MICR indicia.

* * * * *